United States Patent [19]

Brückner

[11] Patent Number: 5,054,664

[45] Date of Patent: Oct. 8, 1991

[54] INDUCTIVELY HEATABLE REFRACTORY MEMBER, INDUCTIVE COIL EMPLOYABLE THEREWITH, AND PROCESS FOR USE THEREOF

[75] Inventor: Raimund Brückner, Niedernhausen-Engenhahn, Fed. Rep. of Germany

[73] Assignee: Didier-Werke AG, Wiesbaden, Fed. Rep. of Germany

[21] Appl. No.: 562,382

[22] Filed: Aug. 3, 1990

Related U.S. Application Data

[62] Division of Ser. No. 450,921, Dec. 14, 1989.

[30] Foreign Application Priority Data

Dec. 19, 1988 [DE] Fed. Rep. of Germany ..... 3842690

[51] Int. Cl.[5] ..... B22D 35/06

[52] U.S. Cl. ..... 222/590; 222/591; 222/593

[58] Field of Search ..... 222/591, 592, 593, 590

[56] References Cited

U.S. PATENT DOCUMENTS 3,435,992 4/1969 Tisdale et al. ..... 222/593

4,475,721 10/1984 Pamart ..... 222/593

*Primary Examiner*—S. Kastler

*Attorney, Agent, or Firm*—Wenderoth, Lind & Ponack

[57] ABSTRACT

A refractory member has therethrough a flow channel for the passage of molten metal. At least an inner wall portion of the refractory member defining the flow channel is at least partially formed of a material that at least partially includes a ceramic material having the properties of being capable of being heated inductively and to being electrically conductive at a temperature at least equal to the liquidus temperature of the molten metal. A primary induction coil, preferably formed of an electrically conductive ceramic material, surrounds the flow channel and inductively heats the material of the inner wall portion to prevent freezing of molten metal within the flow channel and the formation of deposits therein.

22 Claims, 1 Drawing Sheet

INDUCTIVELY HEATABLE REFRACTORY MEMBER, INDUCTIVE COIL EMPLOYABLE THEREWITH, AND PROCESS FOR USE THEREOF

This is a divisional application of Ser. No. 07/450,921 filed Dec. 14, 1989.

BACKGROUND OF THE INVENTION

The present invention relates to an improved refractory member having therethrough a flow channel and adapted for use wherein molten metal is to flow through the flow channel. The present invention particularly relates to such a refractory member including at least a portion that is inductively heatable, and a further aspect of the present invention involves an inductive coil employable therewith. Yet further, the present invention is directed to an improved process for use of such refractory member and coil, particularly to prevent freezing of molten metal flowing through the flow channel in the refractory member as well as to prevent the formation within the flow channel of deposits of impurities from the molten metal.

The present invention particularly is directed to refractory connections to be employed for conveying molten metal between a molten metal containing metallurgical vessel and a discharge mechanism for discharging the molten metal from the vessel, particularly a refractory nozzle employed in the discharge of molten steel.

A problem with prior art refractory nozzles of this type is that the molten metal freezes within the flow channel through the nozzle. This particularly is true when the molten metal, for example steel, is cast continuously through the nozzle into molds for the formation of thin slabs. This is due to the relatively small cross-section of the nozzle necessary to achieve such casting. An additional problem is that impurities from the molten metal, for example alumina, tend to deposit within the flow channel.

SUMMARY OF THE INVENTION

With the above discussion in mind it is an object of the present invention to provide an improved refractory member having therethrough a flow channel and adapted for use wherein a molten metal is to flow through the flow channel, whereby it is possible to avoid the above and other prior art disadvantages.

It is a further object of the present invention to provide such a refractory member wherein such prior art disadvantages are overcome by inductively heating at least a portion of the refractory member and/or the molten metal passing through the flow channel therethrough.

It is a still further object of the present invention to provide an inductive coil member for use in achieving such inductive heating.

It is an even further object of the present invention to provide an improved process for flowing a molten metal through a flow channel in a refractory member whereby it is possible, by inductively heating at least a portion of the refractory member and/or the molten metal, to prevent solidification or freezing of the molten metal within the flow channel and to prevent therein the deposit of impurities from the molten metal.

These objects are achieved in accordance with the present invention by providing that at least an inner wall portion of the refractory member defining the flow through channel is at least partially formed of a material that at least partially includes a ceramic material having the properties of being capable of being heated inductively and of being electrically conductive at a temperature at least equal to the liquidus temperature of the molten metal. Such ceramic material particularly is provided along that portion of the flow channel through the refractory member whereat freezing of the molten metal is likely to occur and/or where the formation of deposits of impurities from the molten metal is likely to occur. Furthermore, the provision of such ceramic material is provided at regions or portions of the flow channel through the refractory member that already will be heated by the molten metal flowing therethrough. Thus, the inner wall portion of the refractory member, defining the flow channel, is heated by the molten metal, and the inductive heating can begin at the temperature of such heating and continue up to a minimum of or above the liquidus temperature of the molten metal, i.e. the minimum temperature at which the metal is in a liquid state.

Induction furnaces are known wherein the walls of a heating chamber of such a furnace are heated by means of an induction coil enclosing such chamber, for example as disclosed in British GB 2,121,028A. It also is known to control the passage of molten metal during a continuous casting operation, per European EP 0 155 575 B1, by arranging an electromagnetic coil concentrically around the pouring or discharge tube to achieve an electromagnetic contraction of the pouring stream by driving the coil electrically and thus to obtain a reduced cross-section of the molten metal flow. At the same time, it is possible that a certain amount of inductive heating of the molten metal will occur in the range of effectiveness of the coil when arranged a small distance around the discharge tube. However, freezing of the molten metal and the formation of deposits within the tube occurs in such known arrangement.

In accordance with the present invention, an induction coil, known in general, is employed in a completely novel manner and use, i.e. specifically to avoid freezing or solidification of the molten metal within a flow channel in a refractory member, such as a nozzle, and to prevent undesired formation of deposits of impurities from the molten metal. This is done by inductively heating the walls themselves of the refractory member, i.e. nozzle. Such walls themselves are heated to or held at a temperature at which the above disadvantageous phenomena are avoided. In other words, the inductive hearing is conducted to a temperature sufficient to prevent the freezing within the flow channel of the molten metal and/or the formation within the flow channel of deposits of impurities from the molten metal. Such temperature for a particular installation involving particular nozzle dimensions and a particular molten metal would be understood by one skilled in the art.

In accordance with the present invention, the entire refractory member can be formed of the ceramic material having the properties of being capable of being heated inductively and being electrically conductive at a temperature at least equal to the liquidus temperature of the molten metal. However, it is contemplated in accordance with the present invention that only the inner wall portion of the refractory member be formed of such ceramic material. It further is contemplated that only part or parts of such inner wall portion of the refractory member be formed of such ceramic material. Thus, the refractory member, for example nozzle, can be made of or can be made to include such electrically conductive ceramic material over its entire length, or over a portion only of its length. A primary induction coil is provided around the particular length of the refractory member involved. For particularly long nozzles it is possible to space two or more longitudinal sections formed of or including the ceramic material in sequence so that as the molten metal flows through the nozzle the temperature of the molten metal and/or the temperature of such longitudinal sections is raised repeatedly to the required temperature necessary to prevent the molten metal from solidifying and/or to prevent the formation of deposits.

The refractory material of the refractory member, or at least the particular longitudinal section of the inner wall portion thereof, can include the particular ceramic material or be entirely formed thereof. A preferred electrically conductive, inductively heatable ceramic material is one that is formed of or includes $ZrO_2$. Such materials are known as jackets for induction coils and also exhibit excellent erosion and corrosion resistance to molten metal. Preferably the $ZrO_2$ is stabilized by means of $Y_2O_3$, CaO and/or MgO for the purpose of providing an effective thermal coupling of the electromagnetic coil and the electrically conductive, inductively heatable ceramic material.

In accordance with a particularly preferred arrangement of the present invention, the primary induction coil itself can be formed of an electrically conductive ceramic material. This feature especially is advantageous if, for energy reasons, cooling is to be avoided. The primary coil can be a component of the nozzle wall, for example embedded therein. In accordance with a further feature of the present invention, the output of the primary coil can be controlled such that the inductive heating achieved thereby is controllable. It thus is possible to control or adjust a temperature to which the molten metal is heated and/or to adjust the temperature as necessary to prevent solidification of the molten metal and prevent the formation of deposits. Thus, a frequency adjustable power source can be connected to the coil. It is contemplated that a range of frequency adjustment preferably should be approximately from 3 to 10 MHz.

A further aspect of the present invention involves the provision of such an induction coil member for use in inductively heating such an electrically conductive ceramic material, and particularly a primary induction coil formed of an electrically conductive ceramic material or components made thereof. One skilled in the art readily would understand what particular electrically conductive ceramic materials would be employable for the primary induction coil. In this manner, it is possible, without difficulty, to be able to continuously operate the induction coil in an efficient manner, without the need for cooling.

Another aspect of the present invention involves an improved process of flowing the molten metal through a flow channel extending through a refractory member, particularly providing at least an inner wall portion of the member defining the flow channel to be at least partially formed of material that at least partially includes a ceramic material having the properties of being capable of being heated inductively and of being electrically conductive at a temperature at least equal to the liquidus temperature of the molten metal, and inductively heating such ceramic material, preferably by a primary induction coil formed of an electrically conductive ceramic material. It thereby is possible to prevent solidification of the molten metal within the flow channel and to prevent the formation therein of deposits. Thus, it is possible to inductively heat the inner wall portion of the refractory member and/or the molten metal. This particularly is advantageous for use when the refractory member is a nozzle employed for discharging the molten metal from a molten metal containing metallurgical vessel to a discharge member, such as a sliding closure unit.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
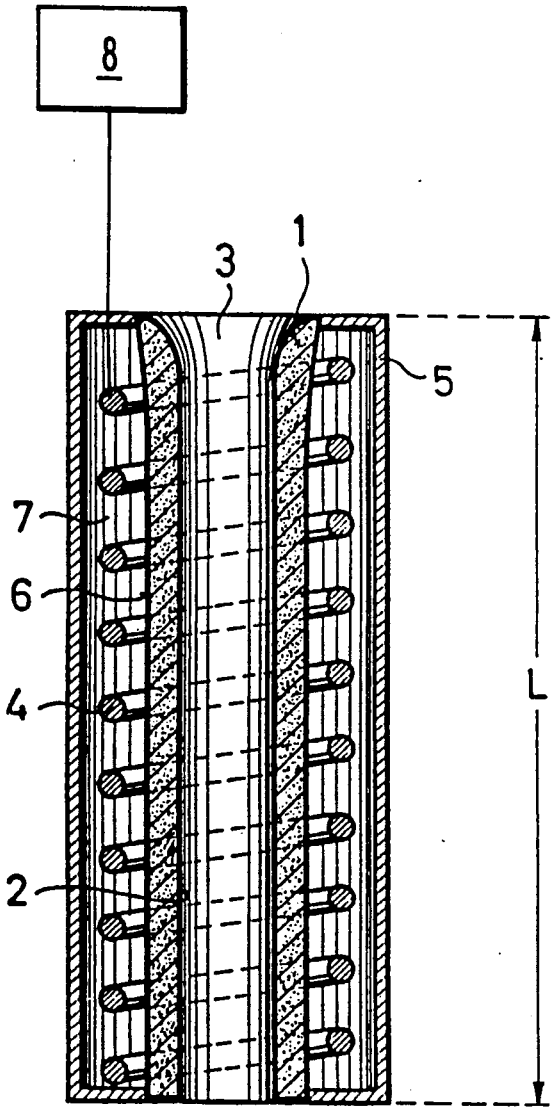
FIGS. 1 and 2 are partially schematic longitudinal cross sectional views of refractory members in accordance with two embodiments encompassing the present invention.

Illustrated in FIG. 1 is a discharge nozzle including a refractory member 1 including an inner wall portion having an inner surface 2 defining a flow channel 3 and an outer wall 6. A primary induction coil 4 is positioned concentrically about the refractory member within a space 7 defined between outer surface 6 and a metal shield 5 that shields stray radiation and that can be cooled. Space 7 can be filled with a thermally insulating material, for example granulate $ZrO_2$. Primary coil 4 can be connected to a frequency dependent or frequency adjustable power source 8 with a controllable or adjustable output. The inner wall portion of the arrangement in FIG. 1 is entirely formed of a ceramic material having the properties of being capable of being heated inductively-and to being electrically conductive at a temperature at least equal to the liquidus temperature of molten metal to the pass through flow channel 3. However, the inner wall portion could be formed of a refractory material that includes such a ceramic material. Also, such ceramic material could be provided over only a portion of the longitudinal dimension of the flow channel. Since in the illustrated arrangement the ceramic material is provided throughout the longitudinal dimension of the flow channel, primary coil 4 is provided over the entire length L thereof.

By operating source 8 and thereby coil 4, it is possible to inductively heat inner wall surface 2. This can be achieved in a controlled manner to a necessary temperature, or to a temperature after the inner wall has been heated by molten metal passing through channel 3. At any rate, the temperature of inner wall surface 2 and/or the molten metal is inductively heated sufficiently to prevent the molten metal from freezing within channel 3 and to prevent the formation therein of deposits, for example of impurities, from the molten metal. Inner wall surface 2 can be provided with an electrically insulating layer or jacket with respect to the molten metal, for example steel.

Figure 2:
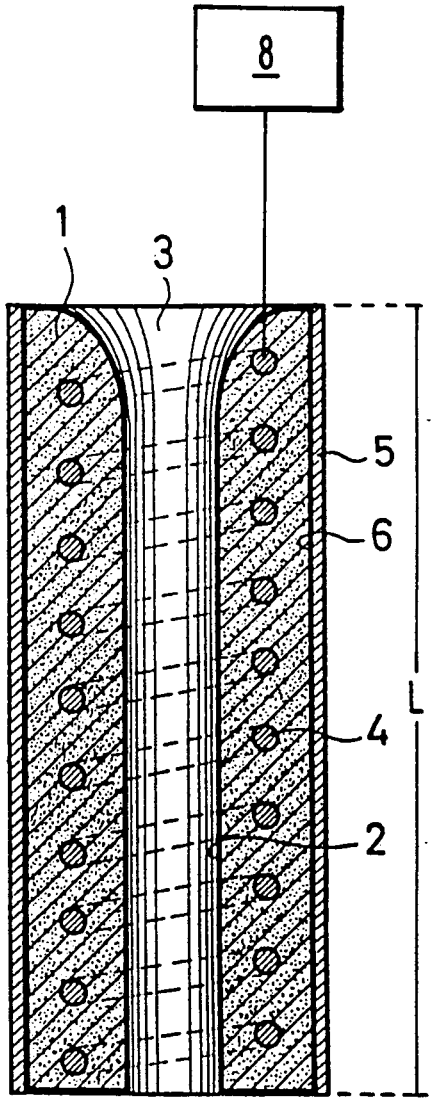

The embodiment of FIG. 2 is similar to the embodiment of FIG. 1, with the exception that the coil 4 is embedded within the material of the refractory member. In this embodiment, metal shield 5 directly abuts the outer wall 6 and can, if necessary, be cooled. Even in this embodiment inner wall surface 2 can be provided with an electrically insulating layer or jacket with respect to the molten metal.

In accordance with the present invention, the primary coil 4 can be designed in such a manner that its induced magnetic field can be focused in a direction parallel to the longitudinal axis of the nozzle or vertically thereto. This accordingly can influence the flow of the molten metal.

In a particularly preferred arrangement of the present invention, the primary coil itself is formed of an electrically conductive ceramic material. This makes it unnecessary to provide for cooling of the coil. A device equipped with coil 4 can also be used for other heating applications.

Although the present invention has been described and illustrated with respect to preferred features thereof, it is to understood that various modifications and changes may be made to the specifically described and illustrated features without departing from the scope of the present invention.

What is claimed is:

1. In a process of flowing a molten metal through a flow channel extending through a refractory member, the improvement comprising:

providing said member defining said flow channel to be of a unitary and integral construction and entirely formed of a material that at least partially includes a ceramic material having the properties of being capable of being heated inductively and of being electrically conductive at a temperature at least equal to the liquidus temperature of said molten metal; and inductively heating said ceramic material.

2. The improvement claimed in claim 1, wherein said heating comprises raising the temperature of an inner wall portion of said member at least to said liquidus temperature.

3. The improvement claimed in claim 2, comprising raising said temperature sufficiently to prevent solidification of said molten metal within said flow channel and to prevent the formation therein of deposits of impurities from said molten metal.

4. The improvement claimed in claim 1, wherein said heating comprises raising the temperature of said molten metal sufficiently to prevent solidification thereof within said flow channel and to prevent the formation therein of deposits of impurities from said molten metal.

5. The improvement claimed in claim 1, comprising performing said heating by a primary induction coil surrounding said flow channel.

6. The improvement claimed in claim 5, further comprising providing said coil formed of an electrically conductive ceramic material.

7. The improvement claimed in claim 5, further comprising adjusting said heating by means of a frequency adjustable power source connected to said coil.

8. The improvement claimed in claim 5, wherein the frequency of said power source is adjustable over a range of approximately from 3 to 10 MHz.

9. In a process of flowing a molten metal through a flow channel extending through a refractory member, the improvement comprising:

providing at least an inner wall portion of said member defining said flow channel to be at least partially formed of a material that at least partially includes $ZrO_2$ ceramic material having the properties of being capable of being heated inductively and of being electrically conductive at a temperature at least equal to the liquidus temperature of said molten metal; and inductively heating said ceramic material.

10. The improvement claimed in claim 9, wherein said heating comprises raising the temperature of said inner wall portion at least to said liquidus temperature.

11. The improvement claimed in claim 10, comprising raising said temperature sufficiently to prevent solidification of said molten metal within said flow channel and to prevent the formation therein of deposits of impurities from said molten metal.

12. The improvement claimed in claim 9, wherein said heating comprises raising the temperature of said molten metal sufficiently to prevent solidification thereof within said flow channel and to prevent the formation therein of deposits of impurities from said molten metal.

13. The improvement claimed in claim 9, comprising performing said heating by a primary induction coil surrounding said flow channel.

14. The improvement claimed in claim 13, further comprising providing said coil formed of an electrically conductive ceramic material.

15. The improvement claimed in claim 13, further comprising adjusting said heating by means of a frequency adjustable power source connected to said coil.

16. The improvement claimed in claim 15, wherein the frequency of said power source is adjustable over a range of approximately from 3 to 10 MHz.

17. In a process of flowing a molten metal through a flow channel extending through a refractory member, the improvement comprising:

providing at least an inner wall portion of said member defining said flow channel to be at least partially formed of a material that at least partially includes a ceramic having the properties of being capable of being heated inductively and of being electrically conductive at a temperature at least equal to the liquidus temperature of said molten metal;

providing a primary induction coil formed of an electrically conductive ceramic material and surrounding said flow channel; and inductively heating said ceramic material of said member by means of said coil.

18. The improvement claimed in claim 17, wherein said heating comprises raising the temperature of said inner wall portion at least to said liquidus temperature.

19. The improvement claimed in claim 18, comprising raising said temperature sufficiently to prevent solidification of said molten metal within said flow channel and to prevent the formation therein of deposits of impurities from said molten metal.

20. The improvement claimed in claim 17, wherein said heating comprises raising the temperature of said molten metal sufficiently to prevent solidification thereof within said flow channel and to prevent the formation therein of deposits of impurities from said molten metal.

21. The improvement claimed in claim 17, further comprising adjusting said heating by means of a frequency adjustable power source connected to said coil.

22. The improvement claimed in claim 21, wherein the frequency of said power source is adjustable over a range of approximately from 3 to 10 MHz.

* * * * *